US008673812B2

(12) United States Patent
Ohse et al.

(10) Patent No.: US 8,673,812 B2
(45) Date of Patent: Mar. 18, 2014

(54) THERMOSENSITIVE RECORDING MEDIUM

(75) Inventors: Katsuto Ohse, Tokyo (JP); Yasuaki Matsumori, Tokyo (JP); Yoshimi Midorikawa, Tokyo (JP); Yukiko Satou, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 13/375,375

(22) PCT Filed: Jun. 3, 2010

(86) PCT No.: PCT/JP2010/059462
§ 371 (c)(1),
(2), (4) Date: Jan. 26, 2012

(87) PCT Pub. No.: WO2010/140662
PCT Pub. Date: Dec. 9, 2010

(65) Prior Publication Data

US 2012/0129692 A1 May 24, 2012

(30) Foreign Application Priority Data

Jun. 5, 2009 (JP) ..... 2009-135816
Sep. 14, 2009 (JP) ..... 2009-211199

(51) Int. Cl.
*B41M 5/41* (2006.01)

(52) U.S. Cl.
USPC ..... 503/200; 503/226

(58) Field of Classification Search
USPC ..... 503/200–226
See application file for complete search history.

(56) References Cited

U.S. PATENT DOCUMENTS

| | | | |
|---|---|---|---|
| 4,032,690 | A | 6/1977 | Kohmura et al. |
| 4,243,716 | A | 1/1981 | Kosaka et al. |
| 4,265,978 | A | 5/1981 | Morishita et al. |
| 6,037,308 | A | 3/2000 | Sato et al. |
| 6,656,880 | B2 | 12/2003 | Aono |
| 6,680,281 | B2 | 1/2004 | Tajiri et al. |
| 7,157,407 | B2 | 1/2007 | Serizawa |
| 7,618,922 | B2 | 11/2009 | Ogino et al. |
| 8,129,307 | B2 | 3/2012 | Makihara et al. |
| 8,247,347 | B2 | 8/2012 | Takagi et al. |
| 8,283,284 | B2 | 10/2012 | Hirai et al. |
| 8,466,085 | B2 | 6/2013 | Kato et al. |
| 8,492,308 | B2 | 7/2013 | Kurihara et al. |
| 8,609,582 | B2 | 12/2013 | Hirai et al. |
| 2002/0121351 | A1 | 9/2002 | Takano et al. |
| 2003/0045426 | A1 | 3/2003 | Ito |
| 2004/0198603 | A1 | 10/2004 | Kawakami et al. |
| 2004/0241598 | A1 | 12/2004 | Suga et al. |
| 2005/0118526 | A1 | 6/2005 | Suga et al. |
| 2006/0264326 | A1 | 11/2006 | Fisher et al. |
| 2008/0139385 | A1 | 6/2008 | Ogino et al. |
| 2008/0214786 | A1 | 9/2008 | Oyama |
| 2010/0062935 | A1 | 3/2010 | Takagi et al. |
| 2010/0099557 | A1 | 4/2010 | Makihara et al. |
| 2010/0248959 | A1 | 9/2010 | Kato et al. |
| 2011/0105319 | A1 | 5/2011 | Hirai et al. |
| 2011/0130281 | A1 | 6/2011 | Kurihara et al. |
| 2011/0269622 | A1 | 11/2011 | Ohse et al. |
| 2012/0038737 | A1 | 2/2012 | Hirai et al. |
| 2013/0059728 | A1 | 3/2013 | Ohse et al. |

FOREIGN PATENT DOCUMENTS

| | | |
|---|---|---|
| CN | 1368578 | 9/2002 |
| EP | 0 465 665 | 1/1992 |
| EP | 0 764 635 | 3/1997 |
| EP | 0 779 539 | 6/1997 |
| EP | 1 116 713 | 7/2001 |
| EP | 1 199 185 | 4/2002 |
| EP | 1 367 437 | 12/2003 |
| EP | 1 437 231 | 7/2004 |
| EP | 1 747 898 | 1/2007 |
| EP | 1 808 304 | 7/2007 |
| EP | 2 072 274 | 6/2009 |
| EP | 2 145 771 | 1/2010 |
| GB | 2 187 297 | 9/1987 |
| JP | 53-091995 | 8/1978 |
| JP | 54-128349 | 10/1979 |
| JP | 57-165290 | 10/1982 |
| JP | 60-179190 | 9/1985 |
| JP | 60-179290 | 9/1985 |
| JP | 61-181680 | 8/1986 |
| JP | 61-291179 | 12/1986 |
| JP | 62-270383 | 11/1987 |
| JP | 1-196389 | 8/1989 |

(Continued)

OTHER PUBLICATIONS

Extended European Search Report corresponding to European Patent Application No. 08 827 733.0-2304 dated Jan. 27, 2012.
European European Search Report corresponding to European Patent Application No. 09 725 687.9-2304 dated Feb. 24, 2012.
International Search Report corresponding to International Patent Application No. PCT/JP2007/074385 dated Feb. 14, 2008.
International Search Report corresponding to International Patent Application No. PCT/JP2008/051100 dated Apr. 15, 2008.
International Search Report corresponding to International Patent Application No. PCT/JP2008/054719 dated Sep. 22, 2008.

(Continued)

*Primary Examiner* — Bruce H Hess
(74) *Attorney, Agent, or Firm* — Jenkins, Wilson, Taylor & Hunt, P.A.

(57) ABSTRACT

The present invention present a thermosensitive recording medium having excellent printed image quality on a thermosensitive recording surface, particularly for bar code readability, and also good record density and recording property after storage.

In a thermosensitive recording medium obtained by installing on a substrate a thermosensitive recording layer containing a colorless or pale electron donating leuco dye and an electron accepting coloring agent, the water drop absorbency of the surface on which a thermosensitive recording layer is installed on said substrate is adjusted to at least 50 seconds by having at least 5 wt. % of mechanical pulp present in the substrate and controlling the sizing agent treatment of the substrate.

13 Claims, No Drawings

(56) References Cited

FOREIGN PATENT DOCUMENTS

| | | |
|---|---|---|
| JP | 2-55188 | 2/1990 |
| JP | 03 047790 | 2/1991 |
| JP | 3-190786 | 8/1991 |
| JP | 3-205181 | 9/1991 |
| JP | 3-219993 | 9/1991 |
| JP | H04-164687 | 6/1992 |
| JP | 05-139033 | 6/1993 |
| JP | 5-162443 | 6/1993 |
| JP | 5-221115 | 8/1993 |
| JP | H06-155916 | 6/1994 |
| JP | 6-234275 | 8/1994 |
| JP | 6-262853 | 9/1994 |
| JP | H06-270547 | 9/1994 |
| JP | H06-286308 | 10/1994 |
| JP | 6-340171 | 12/1994 |
| JP | 7149713 | 6/1995 |
| JP | 07-179041 | 7/1995 |
| JP | H07-266711 | 10/1995 |
| JP | 07-314896 | 12/1995 |
| JP | H08-059603 | 3/1996 |
| JP | 08-207443 | 8/1996 |
| JP | 08-324123 | 12/1996 |
| JP | H08-333329 | 12/1996 |
| JP | H09-142018 | 6/1997 |
| JP | H09-207435 | 8/1997 |
| JP | H09-263047 | 10/1997 |
| JP | H10-250232 | 9/1998 |
| JP | H10-258577 | 9/1998 |
| JP | 10-272839 | 10/1998 |
| JP | H10-297089 | 11/1998 |
| JP | H10-297090 | 11/1998 |
| JP | 10-324062 | 12/1998 |
| JP | 10-324064 | 12/1998 |
| JP | 11-314454 | 11/1999 |
| JP | 2000-143611 | 5/2000 |
| JP | 2000-168242 | 6/2000 |
| JP | 2000-177243 | 6/2000 |
| JP | 3058758 | 7/2000 |
| JP | 2000-289333 | 10/2000 |
| JP | 2001-287459 | 10/2001 |
| JP | 2001-322358 | 11/2001 |
| JP | 2001-323095 | 11/2001 |
| JP | 2002-011954 | 1/2002 |
| JP | 2002-019300 | 1/2002 |
| JP | 2002-103789 | 4/2002 |
| JP | 2002-240430 | 8/2002 |
| JP | 2002-264538 | 9/2002 |
| JP | 2002-293023 | 10/2002 |
| JP | 2002-301873 | 10/2002 |
| JP | 2002-341770 | 11/2002 |
| JP | 2003-019861 | 1/2003 |
| JP | 2003-154760 | 5/2003 |
| JP | 2003-212841 | 7/2003 |
| JP | 3439560 | 8/2003 |
| JP | 2003-313795 | 11/2003 |
| JP | 2004-202913 | 7/2004 |
| JP | 2005-001281 | 1/2005 |
| JP | 2005-041013 | 2/2005 |
| JP | 2005-134578 | 5/2005 |
| JP | 2005-154996 | 6/2005 |
| JP | 2005-199554 | 7/2005 |
| JP | 2005-220480 | 8/2005 |
| JP | 2005-262549 | 9/2005 |
| JP | 3716736 | 11/2005 |
| JP | 2006-069032 | 3/2006 |
| JP | 3750786 | 3/2006 |
| JP | 2006-095852 | 4/2006 |
| JP | 2006-168319 | 6/2006 |
| JP | 3790648 | 6/2006 |
| JP | 2006-175835 | 7/2006 |
| JP | 2006-205561 | 8/2006 |
| JP | 2006-264255 | 10/2006 |
| JP | 2006-281472 | 10/2006 |
| JP | 2007-196616 | 8/2007 |
| JP | 2007-231485 | 9/2007 |
| JP | 3971453 | 9/2007 |
| JP | 2008-012879 | 1/2008 |
| JP | 2008-018619 | 1/2008 |
| JP | 2008-044226 | 2/2008 |
| JP | 2008-044227 | 2/2008 |
| JP | 2008-105222 | 8/2008 |
| JP | 2008-194918 | 8/2008 |
| JP | 2008-248408 | 10/2008 |
| JP | 2008-248459 | 10/2008 |
| JP | 2009-012247 | 1/2009 |
| WO | WO 93/06074 | 4/1993 |
| WO | WO95/33714 | 12/1995 |
| WO | WO97/16420 | 5/1997 |
| WO | WO00/14058 | 3/2000 |
| WO | WO01/25193 | 4/2001 |
| WO | WO02/081229 | 10/2002 |
| WO | WO02/098674 | 12/2002 |
| WO | WO03/029017 | 4/2003 |
| WO | WO2004/002748 | 1/2004 |
| WO | WO2005/087503 | 9/2005 |
| WO | WO2005/087504 | 9/2005 |
| WO | WO2005/102725 | 11/2005 |
| WO | WO2006/075467 | 7/2006 |
| WO | WO2007/049621 | 5/2007 |
| WO | WO2008/099658 | 8/2008 |
| WO | WO2008/126635 | 10/2008 |
| WO | WO2008/139948 | 11/2008 |
| WO | WO2009/025316 | 2/2009 |
| WO | WO2009/028118 | 3/2009 |
| WO | WO2009/119813 | 10/2009 |
| WO | WO2010/110209 | 9/2010 |
| WO | WO2010/140662 | 12/2010 |
| WO | WO2011/114780 | 9/2011 |

OTHER PUBLICATIONS

International Search Report corresponding to International Patent Application No. PCT/JP2008/058329 dated Jun. 9, 2008.

International Search Report corresponding to International Patent Application No. PCT/JP2008/064904 dated Oct. 7, 2008.

International Search Report corresponding to International Patent Application No. PCT/JP2009/056306 dated May 19, 2009.

International Search Report corresponding to International Patent Application No. PCT/JP2010/054818 dated Apr. 13, 2010.

International Search Report corresponding to International Patent Application No. PCT/JP2010/059462 dated Aug. 17, 2010.

Isogai et al., "Effects of Carboxyl Groups in Pulp on Retention of Alkylketene Dimer," Journal of Pulp and Paper Science. vol. 23, No. 5 pp. J215-J219 (1997).

Japanese Industrial Standard (JIS) P-8148. Paper, board and pulps—Measurement of diffuse blue reflectance factor (ISO brightness). Japanese Standards Association (2001).

Notice of Allowance corresponding to U.S. Appl. No. 12/520,514 dated Oct. 26, 2011.

Notice of Allowance corresponding to U.S. Appl. No. 12/593,116 dated May 15, 2012.

Notice of Allowance corresponding to U.S. Appl. No. 12/599,617 dated Apr. 16, 2012.

Notification Concerning Transmittal of International Preliminary Report on Patentability (Chapter I of the Patent Cooperation Treaty) corresponding to International Patent Application No. PCT/JP2009/056306 dated Oct. 7, 2010.

Notification Concerning Transmittal of International Preliminary Report on Patentability (Chapter I of the Patent Cooperation Treaty) corresponding to International Patent Application No. PCT/JP2010/054818 dated Sep. 24, 2011.

Notification of Transmittal of Translation of the International Preliminary Report on Patentability (Chapter I or Chapter II of the Patent Cooperation Treaty) corresponding to International Patent Application No. PCT/JP2007/074385 dated Mar. 18, 2010.

Notification of Transmittal of Translation of the International Preliminary Report on Patentability (Chapter I or Chapter II of the Patent Cooperation Treaty) corresponding to International Patent Application No. PCT/JP2008/051100 dated Aug. 27, 2009.

Notification of Transmittal of Translation of the International Preliminary Report on Patentability (Chapter I or Chapter II of the Patent

(56) References Cited

OTHER PUBLICATIONS

Cooperation Treaty) corresponding to International Patent Application No. PCT/JP2008/054719 dated Oct. 29, 2009.
Notification of Transmittal of Translation of the International Preliminary Report on Patentability (Chapter I or Chapter II of the Patent Cooperation Treaty) corresponding to International Patent Application No. PCT/JP2008/058329 dated Jan. 21, 2010.
Notification of Transmittal of Translation of the International Preliminary Report on Patentability (Chapter I or Chapter II of the Patent Cooperation Treaty) corresponding to International Patent Application No. PCT/JP2008/064904 dated Mar. 18, 2010.
Notification of Transmittal of Translation of the International Preliminary Report on Patentability (Chapter I or Chapter II of the Patent Cooperation Treaty) corresponding to International Patent Application No. PCT/JP2009/056306 dated Nov. 18, 2010.
Notification of Transmittal of Translation of the International Preliminary Report on Patentability (Chapter I or Chapter II of the Patent Cooperation Treaty) corresponding to International Patent Application No. PCT/JP2010/054818 dated Jan. 12, 2012.
Notification of Transmittal of Translation of the International Preliminary Report on Patentability (Chapter I or Chapter II of the Patent Cooperation Treaty) corresponding to International Patent Application No. PCT/JP2010/059462 dated Dec. 15, 2011.
Official Action corresponding to U.S. Appl. No. 12/520,514 dated Mar. 10, 2010.
Official Action corresponding to U.S. Appl. No. 12/520,514 dated Oct. 27, 2010.
Official Action corresponding to U.S. Appl. No. 12/593,116 dated Feb. 1, 2012.
Supplementary European Search Report corresponding to European Patent Application No. 08703912.9-1251/2112001 dated Jan. 22, 2010.
Supplementary European Search Report corresponding to European Patent Application No. 08722115.6-1251/2130681 dated Mar. 5, 2010.
Translation, "Explanation for filing a request for early examination," filed in the corresponding JP application (2007-282831) on Feb. 10, 2009.
Translation, "Opinion," filed in the corresponding JP application (2007-282831) on Mar. 24, 2009 in response to an office action of Mar. 9, 2009.
Translation, "Test Report," filed in the corresponding JP application (2007-282831) on Feb. 10, 2009.
Notice of Allowance corresponding to U.S. Appl. No. 12/674,296 dated Apr. 10, 2013.
Notice of Allowance corresponding to U.S. Appl. No. 12/675,701 dated Apr. 4, 2013.
Official Action corresponding to U.S. Appl. No. 12/934,230 dated Apr. 25, 2013.
Japanese Testing Standard J. TAPPI No. 32-2:2000. "Paper-Water Absorption Test Method. Part 2: Water Drop Method." Japan Technical Association of the Pulp and Paper Industry (2000).
Official Action corresponding to U.S. Appl. No. 12/254,381 dated May 28, 2013.
Extended European Search Report corresponding to European Patent Application No. 10 756 006.2-2304 dated Apr. 11, 2012.
International Search Report corresponding to International Patent Application No. PCT/JP2011/051714 dated Apr. 5, 2011.
Notice of Allowance corresponding to U.S. Appl. No. 12/599,617 dated Jun. 27, 2012.
Notice of Opposition corresponding to European Patent Application No. 08 752 259.5-1251/2145771 dated Jun. 14, 2012.
Notification of Transmittal of Translation of the International Preliminary Report on Patentability (Chapter I or Chapter II of the Patent Cooperation Treaty) corresponding to International Patent Application No. PCT/JP2011/051714 dated Nov. 8, 2012.
Official Action corresponding to U.S. Appl. No. 12/674,296 dated Jul. 9, 2012.
Official Action corresponding to U.S. Appl. No. 12/674,296 dated Feb. 6, 2013.
Supplemental Notice of Allowability corresponding to U.S. Appl. No. 12/599,617 dated Aug. 13, 2012.
Japanese Technical Association of the Pulp and Paper Industry TAPPI No. 32-3:2000. "Paper-Water Absorption Test Method. Part 2: Water Drop Method." Test Report.
Notice of Allowance corresponding to U.S. Appl. No. 13/254,381 dated Sep. 25, 2013.
Official Action corresponding to Chinese Patent Application No. 201080024421.8 dated Jul. 29, 2013.
Official Action corresponding to U.S. Appl. No. 13/254,381 dated Aug. 22, 2013.

THERMOSENSITIVE RECORDING MEDIUM

FIELD OF THE INVENTION

The present invention relates to a thermosensitive recording medium with excellent print through resistance when the back side of the thermosensitive recording medium is printed as well as excellent print quality, particularly the bar code reading properties, on the thermosensitive recording surface and good recording property after storage.

BACKGROUND OF THE INVENTION

Thermosensitive recording media are ordinarily prepared by mixing together a colorless or pale-colored electron donating leuco dye and an electron accepting color developing agent, such as a phenolic compound and the like, after grinding them into fine particles, preparing a coating solution by adding a binder, a filler, a sensitivity enhancing agent, a slipping agent and other aids to the mixture and applying the coating solution onto a substrate such as paper, synthetic paper, film, plastic and the like. Thermosensitive recording medium develops color through an instantaneous chemical reaction when heated using a thermal head, hot stamp, hot pen, laser light and the like and yield a recorded image. Thermosensitive recording media are used extensively in recording media such as facsimile devices, computer terminal printers, automatic ticket dispensers, recorders for meters, receipts at super markets and convenience stores and the like. Increasing numbers of receipt recording media print advertisements on the receipt back side, and overall printability (print through resistance, adhesion, printing work properties and the like) is sought in addition to the previously demanded qualities such as color development sensitivity, image quality and the like.

When the back side of a thermosensitive recording medium is subjected to general purpose printing, the ink penetrates to the other side (the surface on which a thermosensitive recording layer is present) and creates a problem (that is, a print through problem) associated with the difficulty reading the letters printed on the thermosensitive recording layer and the like when the degree of substrate opacity is inadequate in the thermosensitive recording medium. Therefore, improving the opacity of the substrate in a thermosensitive recording medium becomes important.

Increasing bulk is commonly used as a method to improve the degree of opacity in paper. In the area of thermosensitive recording medium, a thermosensitive recording medium with improved color developing sensitivity obtained by using a substrate to which a bulking agent such as polyvalent alcohol and the like is added was disclosed. (Reference 1)

In addition, mechanical pulp is used as the material for newspaper, magazines and the like, and the use of mechanical pulp is commonly known to increase the bulk in paper. (Reference 2 etc.)

In addition, a method to suppress the influence that ink jet ink has on a thermosensitive recording surface in a thermosensitive recording medium with ink jet recordability on the back side by installing two undercoating layers between the substrate and the thermosensitive recording layer was disclosed. (Reference 3)

REFERENCES

Reference 1: Japanese Patent Application Public Disclosure No. 2002-293023

Reference 2: Japanese Patent Application Public Disclosure No. H06-28608

Reference 3: Japanese Patent Application Public Disclosure No. 2008-105222

Problems to be Solved

When a bulking agent is added to a substrate to improve the degree of opacity, the substrate rigidity declines and adversely affects the printing properties. In addition, the substrate surface strength also declines, and troubles such as paper peeling, picking and the like are encountered during general printing.

And when mechanical pulp is added to a substrate, a coating solution tends to soak into the substrate as the solution is being applied to create a thermosensitive recording layer on the substrate, and the coating layer coverage and smoothness decline (penetration) and record density and recording property after storage (record density after storage) decline.

Therefore, the objective of the present invention is to present a thermosensitive recording medium having excellent printed image quality on a thermosensitive recording surface, particularly for bar code readability, and also good record density and recording property after storage.

Means to Solve the Problems

The inventors conducted an intense study of the problems described above and discovered that the problems described above could be solved by having mechanical pulp present in the substrate and controlling the degree of sizing (the extent of treatment using a sizing agent) of the substrate to adjust the water drop absorbency of the surface on which a thermosensitive recording layer is installed on said substrate to at least 50 seconds in a thermosensitive recording medium obtained by installing a thermosensitive recording layer containing a colorless or pale electron donating leuco dye and electron accepting color developing agent. The present invention was completed based on the discovery.

That is, the present invention is a thermosensitive recording medium having a thermosensitive recording layer containing a colorless or pale electron donating leuco dye and electron accepting color developing agent on a support, wherein the support comprises pulps containing at least 5 weight % of mechanical pulp, and water drop absorbency of a surface of the support on which the thermosensitive recording layer is installed is at least 50 seconds, wherein the water drop absorbency is measured according to the testing standard J. TAPPI No. 32-2:2000 of Japan Technical Association of the Pulp and Paper Industry with the exception that the volume of the water drop is 0.001 ml.

Advantages of the Invention

A thermosensitive recording medium with excellent quality in the imaged printed on the thermosensitive recording surface, particularly the bar code readability (that is, very little print through), and also good record density and recording property after storage even when the back side of the thermosensitive recording medium, which is the opposite side of the thermosensitive recording layer, is printed is obtained by the present invention.

DETAILED DESCRIPTION OF THE INVENTION

The following advantages are realized when mechanical pulp is present in the substrate.

In comparison to chemical pulp that contains single wood fibers in an almost original state, mechanical pulp is composed mainly of fractured fibers and fiber bundles. Sheets containing mechanical pulp are bulky for this reason and are highly opaque. Furthermore, mechanical pulp is bound by hydrophobic lignin that allows ink to be absorbed well, and mechanical pulp itself also contains many voids. Therefore, sheets containing mechanical pulp retain hydrophobic ink very well.

In contrast, sheets containing a hydrophilic bulking agent are bulky and highly opaque but retain hydrophobic ink inadequately to cause the problem of having the ink penetrate to the back sheet surface when printed (that is, a print through problem).

The mechanical pulp used to create a substrate in the present invention is defined as a pulp obtained by physically grinding wood and includes pulp that had been treated with chemicals or heat prior to grinding. Ground pulp (GP), refined ground pulp (RGP), semi-chemical pulp (SCP), chemical-ground pulp (CGP), thermo-mechanical pulp (TMP) and the like, for example, may be cited as mechanical pulp. However, the examples are not limited to these examples as long as they are obtained according to the method described above, and the type of pulp may be used individually and in combinations of two or more.

Thermo-mechanical pulp (TMP), in particular, has a better relative scattering coefficient than other mechanical pulps and yields a better degree of opacity. Therefore, TMP is preferred as the substrate for a thermosensitive recording medium of the present invention.

In the present invention, the mechanical pulp may be appropriately mixed with chemical pulp (softwood bleached Kraft pulp (NBKP), softwood unbleached Kraft pulp (NUKP), hardwood bleached Kraft pulp (LBKP), hardwood unbleached Kraft pulp (LUKP)), non-wood pulp and the like depending on the qualities demanded.

Recycled pulp may also be used in the substrate of the present invention.

Recycled pulp refers to the pulp obtained from used paper upon removing the ink from the used paper with a de-inking process. As the inks that may be contained in used paper, printing inks (Japan Printing Society edited "Printing Engineering Handbook", published by Gi Ho Do, p. 606, 1983), non-impact printing inks ("Saishin Tokushu Kono Ink" (Latest Special Function Ink), CMC, p. 1, 1990) and non-heating, penetration drying off-set inks used in newspaper and recycled paper magazines (Akeyuki Goto, Journal of Japan Printing Society, 38(5), 7, (2001)) and the like may be cited.

Recycled paper is roughly classified as recycled paper containing mechanical pulp as the main material pulp such as newspapers, flyers, recycled paper magazines, corrugated paper and the like and recycled paper containing chemical pulp as the main starting material pulp such as coated paper type magazines, thermosensitive or pressure sensitive papers, simili and colored wood free papers, copy paper, computer printout paper and the like.

The mechanical and chemical pulps contained in recycled paper retain their properties. The mechanical pulp contained in recycled paper is bulky as described above, and sheets containing recycled paper containing mechanical pulp are highly opaque.

Bagasse pulp, straw pulp and the like may be cited as non-wood pulp.

In the present invention, the content of mechanical pulp in the total pulp content of a substrate is at least 5 wt. %, preferably from 5 wt. % to 95 wt. %, more preferably from 10 wt. % to 50 wt. % and even more preferably from 10 wt. % to 25 wt. %.

When the content of mechanical pulp in the entire pulp mixture in a substrate is less than 5 wt. %, a sufficient degree of opacity is difficult to achieve and the print through resistance cannot be obtained. Simultaneously, when the content with which mechanical pulp is mixed exceeds 25 wt. %, the print through resistance is improved but the surface smoothness of the substrate tends to decline. As a result, the coated surface uniformity declines when a thermosensitive recording layer is applied on such a substrate and the printed image resolution declines. Therefore, the improvement in bar code readability tends to plateau. Problems such as paper peeling that causes the surface substrate layer to peel due to ink tackiness (tack) during printing, an extensive decline in the printed image resolution resulting from declines in record density and recording property after storage and a decline in substrate strength accompanying a reduction in pulp fiber tangling (inter-fiber bonding) are occasionally encountered when the content of the mechanical pulp exceeds 50 wt. %.

When a recycled pulp is used, the mechanical pulp present in the recycled pulp is included in the mechanical pulp proportion, and the proportion in which mechanical pulp is present in a recycled pulp is measured according to JIS P8120. The content of recycled pulp in total pulp of the substrate is preferably from 5 wt. % to 95 wt. %, more preferably from 5 wt. % to 80 wt. % and more preferably from 5 wt. % to 60 wt. % for the purpose of optimizing the balance between print through resistance and printed image resolution.

Filler may also be added to a substrate to improve the degree of brightness and degree of opacity. As the filler, the traditionally well-known fillers that are commonly used may be used. As specific examples, both inorganic Fillers such as calcium carbonate, kaolin, clay, white carbon, titanium oxide and the like and organic fillers such as styrene-methacrylic copolymer resins, urea-formalin resins, polystyrene resins and the like may be cited. The amount of fillers added is not particularly restricted, but the amount is preferably adjusted to from 2% to 20% of the ash content in the substrate. Now pulp fiber tangling is adversely affected when the substrate ash content exceeds 20%, and the risk that sufficient strength may not be achieved exists. The ash content of the substrate is measured according to JIS P8251.

In the substrate for a thermosensitive recording medium of the present invention, the water drop absorbency of the surface on which a thermosensitive recording layer is installed is at least 50 seconds.

The water drop absorbency is measured according to the Paper Pulp Technology Association, J. TAPPI No. 32-2:2000 (paper-water absorbance test method, section 2: drop method) with the exception that 1 μl (0.001 ml) is used as the amount of the water drop. That is, a test piece (paper) for a measurement is positioned horizontally, and 1 μl (0.001 ml) of distilled water dropped on the surface (that is, the surface on which a thermosensitive recording layer is to be installed). The time until the dropped water is absorbed is measured by visual inspection. The size of the test piece (paper) for the measurement is the size that makes the measurement possible. For example, a disk with a diameter of at least about 40 mm is acceptable.

The water drop absorbency is represented by the time (seconds), and water absorbance worsens with faster water drop absorbency while water absorbance improves with slower water drop absorbency.

By achieving a water drop absorbency of at least 50 seconds on the substrate surface on which a thermosensitive recording layer is installed, the penetration of the coating solution is suppressed when coating the thermosensitive recording layer solution onto the substrate, the effective layer thickness of the coating layer is increased, and a uniform coated surface is obtained. The printed image resolution is improved as a result, and good bar code readability, record density and recording property after storage are obtained. The water drop absorbency is preferably at least 80 seconds, and at least 100 seconds is more preferable. The bar code readability, record density and recording property after storage are good when the water drop absorbency is high. When the water drop absorbency of a substrate surface to which a thermosensitive recording layer is applied is less than 50 seconds, the penetration of the coating solution is much when the thermosensitive recording layer is applied to the substrate and sufficient bar code readability, record density and recording property after storage cannot be obtained. In contrast, an excessively slow water drop absorbance time could result in problems due to ink repellence in general purpose printing such as uneven printing (particularly, uneven intensity where inks overlap) and due to reduced ink fixability such as set-off (ink transfer after printing to other printed materials and printing rollers). Therefore, a water drop absorbency of 300 seconds or less is preferred, and 200 seconds or less is more preferred.

In the present invention, the water drop absorbency of the substrate surface on which a thermosensitive recording layer is installed is controlled using a sizing agent treatment of the substrate. The sizing agent may be added internally in a paper making step in which the substrate is prepared (internal addition) or applied after the preparation (external addition). The sizing agent is preferably applied after the substrate is prepared (external addition). The desired water drop absorbency can be attained by appropriately selecting and controlling the sizing agent type, amount used and addition method according to the pulp in the substrate.

Internal addition refers to a method in which a sizing agent is added to a pulp slurry at the so-called wet end to add the sizing agent to the substrate internally in the paper making step. External addition refers to a method in which a sizing agent is applied to a substrate surface using a coating device represented by a blade coater, gate roll coater, size press coater, rod metalling size press and the like, after the substrate is made.

As the sizing agent for internal addition (internal sizing agents), a reinforced rosin sizing agent, emulsion sizing agent, synthetic sizing agent and the like may be used when an acidic preparation process is conducted and an alkyl ketene dimer (AKD), alkenyl succinic anhydride (ASA) and the like may be used when a neutral preparation process is conducted.

In addition, as the sizing agent for external addition (external sizing agent), cationic polymers and anionic polymers such as styrene-maleic acid type copolymer resins, styrene-acrylic acid copolymer resins and the like, cationic polymers such as styrene type polymers, isocyanate type polymers and the like, alkyd resin saponified materials such as rosin, toll oil and phthalic acid, anionic low molecular weight compounds such as saponified products of petroleum resins and rosin, α-olefin-maleic acid type copolymer resins, acrylate ester-acrylic acid type copolymer resins, and alkyl ketene dimers (AKD) may be cited. However, cationic polymers of styrene-acrylic acid type copolymer resins and alkyl ketene dimers (AKD) that may interact readily with the carboxyl groups in cellulose in a neutral paper making process are preferred, and cationic polymers of styrene-acrylic acid type copolymer resins are particularly preferred.

When the mechanical pulp described above is present in a substrate, the substrate most commonly becomes bulky and the water drop absorbency tends to decline due to the increase in voids in the substrate.

When a substrate contains recycled pulp, the water drop absorbency of the substrate tends to decline due to the influence of the surface activation agent and the like present in the recycled pulp.

Desired water drop absorbency can be obtained even under these circumstances by appropriately selecting and adjusting the type, amount used and addition method of the sizing agent.

Now, the water drop absorbency of the surface on which a thermosensitive recording layer is installed is identical to that measured for the other side of the thermosensitive recording medium when a sizing agent is added only internally during a paper making process or when the same sizing agent is applied on the surface on which a thermosensitive recording layer is installed and on the other side (that is, the printing surface).

The paper making process for a substrate is not particularly restricted, and a long screen machine and a circular screen machine containing a top wire and the like, machines that combine them both, a Yankee dryer machine and the like may be used. In addition, the paper making method may be appropriately selected from an acidic paper making method, a neutral paper making method and an alkaline paper making method and is not particularly restricted.

Chemicals ordinarily used in paper making processes such as various paper making aids such as a paper strengthener, de-foaming agent, coloring agent and the like, for example, may also be appropriately added to a substrate as needed. The amount of a sizing agent added internally may be the amount that imparts desired water drop absorbency, and is preferably from 0.1 wt. % to 1 wt. %, more preferably from 0.05 wt. % to 0.5 wt. % per pulp weight in terms of solid fraction.

For the external sizing agent addition, a well-known coating device such as a blade coater, gate roll coater, size press coater, rod metalling size press and the like, for example, may be used. A coating solution containing the sizing agent described above for external addition is applied or impregnated on a substrate and may also contain a water soluble polymeric substance for improving surface strength, pigment and the like.

As the water soluble polymeric substance for improving surface strength, starches such as starch, enzyme modified starch, thermochemically modified starch, oxidized starch, esterified starch, etherified starch (for example, hydroxy ethylated starch and the like), cationic starch and the like; poly(vinyl alcohols) such as poly(vinyl alcohol), completely saponified poly(vinyl alcohol), partially saponified poly(vinyl alcohol), carboxyl modified poly(vinyl alcohol), silanol modified poly(vinyl alcohol), cation modified poly(vinyl alcohol), terminal alkyl modified poly(vinyl alcohol) and the like; polyacrylamides such as polyacrylamide, cationic polyacrylamide, anionic polyacrylamide, amphoteric polyacrylamide and the like; styrene-butadiene copolymers, poly(vinyl acetate), vinyl chloride-vinyl acetate copolymers, poly(vinyl chloride), poly(vinylidene chloride), poly(acrylate esters) and the like may be cited. These substances may be used solely or as mixtures of at least two.

The coating solution may also contain various aids such as a dispersion agent, plasticizing agent, pH controlling agent, de-foaming agent, water retention agent, preservative, coloring dye, ultraviolet ray inhibitor and the like when needed.

The solid content of a coating solution is appropriately adjusted according to the composition, coating device and the like but is ordinarily from about 5 wt. % to 15 wt. %.

The coating amount with which a sizing agent is externally added may be the amount that imparts a desired water drop absorbency. When a coating device such as a blade coater and the like that can apply a coating to one surface is used to coat the substrate surface on which a thermosensitive recording layer is installed, a dried coating amount of from 0.005 $g/m^2$ to 0.25 $g/m^2$ is preferred and a dried coating amount of from 0.025 $g/m^2$ to 0.125 $g/m^2$ is more preferred.

In addition, when a coating device such as a gate roll coater, size press coater and the like that can simultaneously apply a coating on two sides is used, the coating amount on the substrate surface on which a thermosensitive recording layer is installed is half of the coating amount for both surfaces since the coating is applied evenly on both sides of the substrate.

The basic weight of the substrate of the thermosensitive recording medium of the present invention is preferably from 30 $g/m^2$ to 100 $g/m^2$, more preferably from 40 $g/m^2$ to 80 $g/m^2$ and even more preferably from 40 $g/m^2$ to 50 $g/m^2$. In such cases, the maximum advantage of the present invention is realized; for example, excellent bar code readability is obtained even when the back side of a thermosensitive recording medium is printed. When the basic weight of the substrate is less than 30 $g/m^2$, the risk of the substrate of the thermosensitive recording medium not attaining sufficient strength exists. In addition, when the basic weight exceeds 100 $g/m^2$, a smooth surface is difficult to obtain when a coating layer surface is treated using a calendar and the like, and the record density and recording property after storage tend to decline. The basic weight of a substrate is measured according to JIS P8124.

An undercoating layer may be installed between the substrate and the thermosensitive recording layer in a thermosensitive recording medium of the present invention. The undercoating layer comprises mainly a binder and a pigment.

As the binder, commonly used emulsions of a water soluble polymer or a hydrophobic polymer and the like may be used appropriately. As specific examples, poly(vinyl alcohol), poly(vinyl acetal), cellulose derivatives such as hydroxyethyl cellulose, methyl cellulose, carboxymethyl cellulose and the like, starch and its derivatives, poly(sodium acrylate), poly(vinyl pyrolidone), acrylic acid amide/acrylate ester copolymers, acrylic acid amide/acrylate ester/methacrylic acid copolymers, styrene/maleic anhydride copolymer alkali salts, isobutylene/maleic anhydride copolymer alkali salts, polyacrylamide, sodium alginate, water soluble polymers such as gelatin, casein and the like, emulsions of hydrophobic polymers such as poly(vinyl acetate), polyurethane, styrene/butadiene copolymers, poly(acrylic acid), poly(acrylate esters), vinyl chloride/vinyl acetate copolymers, poly(butyl methacrylate), ethylene/vinyl acetate copolymers, styrene/butadiene/acrylic copolymers and the like may be used. These binders may be used individually or in combinations of at least two.

As a pigment, well-known pigments commonly used previously may be used. As specific examples, inorganic pigments such as calcium carbonate, silica, zinc oxide, titanium oxide, aluminum hydroxide, magnesium hydroxide, sintered kaolin, clay, talc and the like may be used. These pigments may be used individually or in combinations of at least two.

The pigment in the undercoating layer is ordinarily from 50 wt. % to 95 wt. % per total solid fraction and from 70 wt. % to 90 wt. % is preferred.

Various aids such as a dispersion agent, plasticizer, pH controlling agent, de-foaming agent, water retention agent, preservative, coloring dye, UV light inhibiting agent and the like may also be appropriately added to the coating solution for the undercoating layer.

The dried coating amount of the undercoating layer is preferably 15 $g/m^2$ or less, more preferably from 1 $g/m^2$ to 15 $g/m^2$ or even more preferably from 3 $g/m^2$ to 10 $g/m^2$.

Since the substrate of the thermosensitive recording medium of the present invention is designed to have a water drop absorbency of at least 50 seconds for the surface on which a thermosensitive recording layer had been installed, the penetration of the undercoating solution into the substrate is similarly suppressed when an undercoating solution is coated on the support. Therefore, the effective layer thickness of the undercoating layer is large even when the dried coating amount of the undercoating layer is small, and a uniform coated surface is obtained. By applying a coating solution for a thermosensitive recording layer on the coated surface, the penetration of the thermosensitive recording layer coating solution is more suppressed than in a case in which no undercoating layer is installed, the effective layer thickness of the thermosensitive recording layer is thick and a uniform coated surface is obtained. As a result, the printed image quality of the thermosensitive recording surface is particularly good. That is, the bar code readability, record density and recording property after storage are particularly good.

Furthermore, when the back side (that is, the side opposite the thermosensitive recording layer) of a thermosensitive recording medium is printed, the undercoating layer has the effect of inhibiting the ink from penetrating to the thermosensitive recording surface. In the present invention, the effective layer thickness of the undercoating layer is thick as described above and a uniform coated surface is also obtained. Therefore, there is no need to apply a thick undercoating layer or to impart barrier properties to suppress ink penetration by applying multiple layers of undercoating. Thus the dried coating amount of the undercoating layer can be relatively thin in the thermosensitive recording medium of the present invention.

In addition, the other side (that is, the printed surface) of the surface on which a thermosensitive recording layer is installed on a thermosensitive recording medium of the present invention may be the same surface on which the thermosensitive recording layer is installed, but an appropriate surface treatment and the like may also be conducted to make the surface suitable for printing.

A thermosensitive recording layer of the present invention contains an electron donating leuco dye and an electron accepting color developing agent and may also contain a sensitizer, binder, crosslinking agent, stabilizer, pigment, slipping agent and the like when needed.

Various materials used in the thermosensitive recording layer of the present invention are listed as examples, and the materials may also be used in the individual coating layers installed as needed starting with the thermosensitive recording layer and the like.

As the binder used in the present invention, completely saponified poly(vinyl alcohol), partially saponified poly(vinyl alcohol), acetoacetylated poly(vinyl alcohol), carboxyl modified poly(vinyl alcohol), amide modified poly(vinyl alcohol), sulfonic acid modified poly(vinyl alcohol), butyral modified poly(vinyl alcohol), olefin modified poly(vinyl alcohol), nitrile modified poly(vinyl alcohol), pyrolidone modified poly(vinyl alcohol), silicone modified poly(vinyl alcohol), other modified poly(vinyl alcohol), hydroxyethyl cellulose, methyl cellulose, ethyl cellulose, carboxymethyl cellulose, styrene-maleic anhydride copolymers, styrene-butadiene copolymers as well as cellulose derivatives such as ethyl cellulose, acetyl cellulose and the like, casein, gum Arabic, starch oxide, etherified starch, dialdehyde starch, esterified starch, poly(vinyl chloride), poly(vinyl acetate), polyacrylamide, poly(acrylate esters), poly(vinyl butyral), polystyrose and copolymers thereof, polyamide resins, silicone resins, petroleum resins, terpene resins, ketone resins, cumaron resins and the like may be listed as examples. The polymeric substances may be used upon dissolving them in a solvent such as water, alcohol, ketones, esters, hydrocarbons and the like or upon emulsifying or dispersing into a paste in water or other media. The polymeric materials may also be used in combinations according to the qualities demanded.

As the crosslinking agent used in the present invention, glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, borate sand, boric acid, alum, ammonium chloride and the like may be listed as examples.

As the pigment used in the present invention, inorganic pigments such as silica, calcium carbonate, kaolin, calcined kaolin, diatomaceous earth, talc, titanium oxide, aluminum hydroxide and the like may be cited.

As the slipping agent used in the present invention, fatty acid metal salts such as zinc stearate, calcium stearate, and the like, wax, silicone resins and the like may be cited.

In addition, an image stabilizing agent that instills oil resistance in recorded images such as 4,4'-butylidene (6-t-butyl-3-methylphenol), 2,2'-di-t-butyl-5,5'-dimethyl-4,4'-sulfonyl diphenol, 1,1,3-tris(2-methyl-4-hydroxy-5-cyclohexylphenyl)butane, 1,1,3-tris (2-methyl-4-hydroxy-5-t-butylphenyl) butane, 4-benzyloxy-4'-(2,3-epoxy-2-methyl propoxy) diphenylsulfone and the like may also be added in the range that does not adversely affect the desired effects for the problems described above.

In addition, a benzophenone type and triazole type UV light absorption agent, dispersion agent, surface activating agent, de-foaming agent, antioxidant, fluorescent dye and the like may also be used.

All of the dyes well known in the conventional field of pressure sensitive and thermosensitive recording media may be used as the dye in a thermosensitive recording medium of the present invention. Although the dye is not particularly restricted, triphenylmethane type compounds, fluorane type compounds, fluorene type compounds, divinyl type compounds and the like are preferred. Specific examples of the typical colorless to pale colored basic colorless dye are shown below. In addition, these basic colorless dyes may be used individually or also in mixtures of at least two of them.

<Triphenylmethane Type Leuco Dyes>

3,3-bis(p-dimethyl aminophenyl)-6-dimethylaminophthalide[alternate name: crystal violet lactone] and 3,3-bis(p-dimethyl aminophenyl) phthalide[alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p chloroanilino) fluorane, 3-diethylamino-6-methyl-7-(o-fluoroanilino) fluorane, 3-diethylamino-6-methyl-7-(m-methylanilino) fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane; 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloroanilino) fluorane, 3-diethylamino-7-(p-chloroanilino)fluorane, 3-diethylamino-7-(o-fluoroanilino) fluorane, 3-diethylamino-benz[a]fluorine; 3-diethylamino-benz[c] fluorane, 3-dibutylamino-6-methyl-fluorane, dibutylamino-6-methyl-7-anilino fluorane, 3-dibutylamino-6-methyl-7-(o, p-dimethylanilino) fluorane, 3-dibutylamino-7-(o-chloroanilino) fluorane, 3-butylamino-6-methyl-7-(p-chloroanilino) fluorane, 3-dibutylamino-6-methyl-7-(o-fluoroanilino) fluorane, 3-dibutylamino-6-methyl-7-(m-fluoroanilino) fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloroanilino) fluorane, 3-dibutylamino-7-(o-fluoroanilino) fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino) fluorane, 3-n-pentylamino-6-chloro-7-anilino fluorane, 3-di-n-pentylamino-7-(p-chloroanilino) fluorane, 3-pyrrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino) fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-p-(p-dimethylaminophenyl)aminoanilino fluorane, 2-methoxy-6-p-(p-dimethylaminophenyl)aminoanilino fluorane, 2-chloro-3-methyl-6-p-(p-phenylaminophenyl)aminoanilino fluorane, 2-chloro-6-p-(p-dimethylaminophenyl) aminoanilino fluorane, 2-nitro-6-p-(p-diethylaminophenyl) aminoanilino fluorane, 2-amino-6-p-(p-diethylaminophenyl) aminoanilino fluorane, 2-diethylamino-6-p-(p-diethylaminophenyl)aminoanilino fluorane, 2-phenyl-6-methyl-6-p-(p-phenylaminophenyl) aminoanilino fluorane, 2-benzyl-6-p-(p-phenylaminophenyl)aminoanilino fluorane, 2-hydroxy-6-p-(p-phenylaminophenyl)aminoanilino fluorane, 3-methyl-6-p-(p-dimethylaminophenyl)aminoanilino fluorane, 3-diethylamino-6-p-(p-diethylaminophenyl)aminoanilino fluorane, 3-diethylamino-6-p-(p-dibutylaminophenyl)aminoanilino fluorane and 2,4-dimethyl-6-[(4-dimethylamino) anilino]fluorane.

<Fluorene Type Leuco Dye>

3,6,6-Tris(dimethylamino)spiro[fluorene-9,3'-phthalide] and 3,6,6'-tris(diethylamino)spiro[fluorene-9,3'-phthalide].

<Divinyl Type Leuco Dyes>

3,3-bis-[2-(p-dimethyl aminophenyl)-2-(p-methoxyphenyl)ethenyl]-4,5,6,7-tetrabromophthalide, 3,3-bis-[2-(p-dimethylaminophenyl)-2-(p-methoxyphenyl)ethenyl]-4,5,6,7-tetrachlorophthalide, 3,3-bis-[1,1-bis(4-pyrrolidinophenyl)ethylene-2-yl]-4,5,6,7-tetrabromophthalide and 3,3-bis-[1-(4-methoxyphenyl)-1-(4-pyrolydinophenyl)ethylene-2-yl]-4,5,6,7-tetrchlorophthalide.

<Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane γ-(3'-nitro)anilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2",2"-tetrakis(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

All of the color development agents well known in the conventional field of pressure sensitive and thermosensitive recording media may be used as the color development agent in a thermosensitive recording medium of the present invention. Although the dye is not particularly restricted, activated clay, attapulgite, colloidal silica, inorganic acidic substances such as aluminum silicate and the like, 4,4'-isopropylidene diphenol, 1,1-bis(4-hydroxyphenyl)cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, 4-hydroxy-4'-isopropxy diphenyl sulfone, 4-hydroxy-4'-n-propoxy diphenyl sulfone, bis(3-allyl-4-hydroxyphenyl)sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, aminobenzene sulfonamide derivatives described in Japanese Patent Application Public Disclosure No. H08-59603, bis(4-hydroxyphenyl thioethoxy)methane, 1,5-di(4-hydroxyphenyl thio)-3-oxapentane, butyl bis(p-hydroxyphenyl)acetate, methyl bis(p-hydroxyphenyl)acetate, 1,1-bis(4-hydroxyphenyl)-1-phenyl ethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, phenolic compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino]salicylate dihydrate, 4-[2-(p-methoxyphenoxy)ethyloxy]salicylic acid, 4-[3-(p-trisulfonyl)propyloxy]salicylic acid, aromatic carboxylic acids such as 5-[p-(2-p-methoxyphenoxyethoxy) cumyl]salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited. These color development agents may be used individually and in mixtures of at least two. The diphenylsulfone crosslinked type compound described in International Publication WO97/16420 is available under the trade name of D-90 produced by Nippon Soda Co., Ltd. The compound described in International Publication WO02/081229 is also available under the trade names of NKK-395 and D-100 produced by Nippon Soda Co., Ltd. In addition, high molecular weight aliphatic acid metal complex salts described in Japanese Patent Application Public Disclosure No. 1110-258577 and metal chelate type color development components such as polyvalent hydroxy aromatic compounds and the like may also be present.

The previously well known sensitizers may be used as the sensitizer in the thermosensitive recording medium of the present invention. As such sensitizers, aliphatic acid amides such as stearic acid amide, palmitic acid amide and the like, ethylene bis-amide, montan acid wax, polyethylene wax, 1,2-di-(3-methylphenoxy)ethane, p-benzyl biphenyl, β-benzyloxy naphthalene, 4-biphenyl-p-tolyl ether, m-terphenyl, 1,2-diphenoxyethane, dibenzyl oxalate, di(p-chlorobenzyl) oxalate, di(p-methylbenzyl)oxalate, dibenzyl terephthalate, benzyl p-benzyloxy benzoate, di-p-tolyl carbonate, phenyl-α-naphthyl carbonate, 1,4-diethoxynaphthalene, 1-hydroxy-2-naphthoic acid phenyl ester, o-xylene-bis-(phenyl ether), 4-(m-methyl phenoxymethyl)biphenyl, 4,4'-ethylene dioxy-bis-benzoic acid dibenzyl ester, dibenzoyloxy methane, 1,2-di(3-methylphenoxy)ethylene, bis[2-(4-methoxy-phenoxy) ethyl]ether, methyl p-nitrobenzoate and phenyl p-toluene sulfonate may be listed as examples, but the sensitizer is not particularly limited to these examples. These sensitizers may be used individually and as mixtures of at least two of them.

The types and amounts of the electron donating leuco dye, electron receiving color developing agents and other various ingredients used in the thermosensitive recording medium of the present invention are determined according to the required performance and printability and are not particularly restricted. However, from about 0.5 parts to 10 parts of an electron receiving color developing agent, from about 0.5 parts to 10 parts of a sensitizer and about 0.5 parts to 10 parts of a pigment are ordinarily used per 1 part of electron donating leuco dye.

The electron donating leuco dye, electron receiving color developing agents and materials added when needed are finely ground into particles, several microns or smaller in size, using a grinder or a suitable emulsification device such as a ball mill, attritor, sand grinder and the like, and a coating solution is prepared by adding a binder and various additive materials depending on the objective.

In addition, a protecting layer and any other layer that is usually used for the thermosensitive recording medium can be installed on the thermosensitive recording layer.

Any commonly used coating machine may be used to coat each coating layer, such as undercoating layer, thermosensitive recording layer, protecting layer and the like. For example, curtain coaters, air knife coaters, blade coaters, gravure coaters, roller coaters, LIP coaters, bar coaters and the like may be appropriately used.

EXAMPLES

The following examples will illustrate the present invention, but these are not intended to restrict the present invention. In the following description, the terms parts and % indicate parts by weight and wt. %, respectively. The freeness (Canadian Standard Freeness, hereinafter referred to as "CSF") of each pulp is measured according to JIS (Japanese Industrial Standards) P8121.

In the following Examples and Comparative Examples, the density of substrates are adjusted to about 0.7 g/cm$^3$ by treating with machine calendar in order to make the density similar and clarify the effect of the present invention.

The water drop absorbency means that on the surface of the substrate paper on which a thermosensitive recording layer is installed and no undercoating layer is installed.

Substrate 1

0.7 parts of aluminum sulfate and 10 parts of calcium carbonate were added to 100 parts of pulp consisting of 20 parts of TMP with CSF of 90 ml and 80 parts of LBKP with CSF of 300 ml, and these were mixed. The substrate paper was made from the mixed material by using Fourdrinier paper machine. Then a clear size coating solution comprising hydroxyethylated starch (STANLEY Co., ETHYLEX2035) and cationic sizing agent (Harima Chemicals, Inc., cationic polymer of styrene-acrylic acid copolymer, LC-5) was applied on both sides of the substrate paper by using a gate roll coater so that the dried coating amount of hydroxyethylated starch of both sides is 0.67 g/m$^2$ (the dried coating amount on the surface to install the thermosensitive recording layer is 0.335 g/m$^2$) and the dried coating amount of cationic sizing agent of both sides is 0.15 g/m$^2$ (the dried coating amount on the surface to install the thermosensitive recording layer is 0.075 g/m$^2$). Then the substrate paper was super calendared so that the density is 0.7 g/cm$^3$ to yield a paper support with a basic weight of 48 g/m$^2$ and an ash content of 5%. The water drop absorbency on the surface to install the thermosensitive recording layer was 170 sec.

Then the undercoating layer coating solution below was applied on one side of the paper substrate and was dried to prepare an undercoated paper with a coating amount of 5.0 g/m$^2$. Thus prepared undercoated paper support is hereinafter referred to as "substrate 1".

Undercoating Layer Coating Solution

| | |
|---|---|
| Calcined kaolin (Engelhard Co., Ansilex 90, oil absorbance: 90 cc/100 g) | 100 parts |
| Styrene-butadiene copolymer latex (solid content: 48%) | 40 parts |
| 10% Aqueous solution of polyvinyl alcohol | 30 parts |
| Water | 146 parts |

Substrate 2

0.7 parts of aluminum sulfate and 10 parts of calcium carbonate were added to 100 parts of pulp consisting of 20 parts of TMP with CSF of 90 ml and 80 parts of LBKP with CSF of 300 ml, and these were mixed. The substrate paper was made from the mixed material by using Fourdrinier paper machine. Then a clear size coating solution comprising hydroxyethylated starch (STANLEY Co., ETHYLEX2035) and cationic sizing agent (Harima Chemicals, Inc., cationic polymer of styrene-acrylic acid copolymer, LC-5) was applied on both sides of the support paper by using a gate roll coater so that the dried coating amount of hydroxyethylated starch of both sides is 1 g/m$^2$ (the dried coating amount on the surface to install the thermosensitive recording layer is 0.5 g/m$^2$) and the dried coating amount of cationic sizing agent of both sides is 0.06 g/m$^2$ (the dried coating amount on the surface to install the thermosensitive recording layer is 0.03 g/m$^2$). Then the substrate paper was super calendared so that the density is 0.7 g/cm$^3$ to yield a paper substrate with a basic weight of 48 g/m$^2$ and an ash content of 5%. The water drop absorbency on the surface to install the thermosensitive recording layer was 110 sec.

Then the undercoating layer coating solution below was applied on one side of the paper substrate and was dried to prepare an undercoated paper with a coating amount of 8.0 g/m$^2$. Thus prepared undercoated paper substrate is hereinafter referred to as "substrate 2".

Undercoating Layer Coating Solution

| | |
|---|---|
| Calcined kaolin (Engelhard Co., Ansilex 90, oil absorbance: 90 cc/100 g) | 100 parts |
| Styrene-butadiene copolymer latex (solid content: 48%) | 40 parts |
| 10% Aqueous solution of polyvinyl alcohol | 30 parts |
| Water | 146 parts |

Example 1

Thermosensitive Recording Layer

A color development agent dispersion (solution A), a dye dispersion (solution B) and a sensitizer dispersion (solution C) with the following formulation were separately wet ground using sand grinders until the average particle size was about 0.5 μm.

Solution A (Color Development Agent Dispersion)

| | |
|---|---|
| 4-Hydroxy-4'-isopropoxy diphenyl sulfone | 6.0 parts |
| 10% Aqueous solution of polyvinyl alcohol | 18.8 parts |
| Water | 11.2 parts |

Solution B (Dye Dispersion)

| | |
|---|---|
| 3-Dibutylamino-6-methyl-7-anilinofluorane (Yamamoto Chemicals Inc. ODB-2) | 2.0 parts |
| 10% Aqueous solution of polyvinyl alcohol | 4.6 parts |
| Water | 2.6 parts |

Solution C (Sensitizer Dispersion)

| | |
|---|---|
| Di-benzyl Oxalate | 6.0 parts |
| 10% Aqueous solution of polyvinyl alcohol | 18.8 parts |
| Water | 11.2 parts |

Next the dispersions were blended in the proportion described below to prepare a thermosensitive recording layer coating solution, and this thermosensitive recording layer coating solution was applied on the undercoating layer of substrate 1 obtained above with a coating amount of 6.0 g/m$^2$ and was dried. Then the prepared sheet was super calendared to a degree of smoothness of 1,000 to 2,000 seconds to yield a thermosensitive recording medium.

Thermosensitive Color Developing Layer Coating Solution

| | |
|---|---|
| Solution A (color development agent dispersion) | 36.0 parts |
| Solution B (dye dispersion) | 9.2 parts |
| Solution C (sensitizer dispersion) | 36.0 parts |
| Carboxyl modified polyvinyl alcohol | 25.0 parts |
| Surfactant (Nissin Chemical Industry Co., Ltd., Surfynol 104, solid content: 50%) | 0.5 parts |
| Polyamide epichlorohydrin resin | 2.0 parts |

Example 2

A thermosensitive recording medium was prepared in the same manner as described in Example 1 with the exception of changing the pulp formulation to 40 parts of TMP and 60 parts of LBKP. The water drop absorbency on the surface of the substrate to install the thermosensitive recording layer was 150 sec.

Example 3

A thermosensitive recording medium was prepared in the same manner as described in Example 1 with the exception of changing the pulp formulation to 70 parts of TMP and 30 parts of LBKP. The water drop absorbency on the surface of the substrate to install the thermosensitive recording layer was 100 sec.

Example 4

A thermosensitive recording medium was prepared in the same manner as described in Example 1 with the exception of changing the pulp formulation to 10 parts of TMP, 10 parts of RGP with CSF of 70 ml, 5 parts of NBKP with CSF of 470 ml and 75 parts of LBKP. The water drop absorbency on the surface of the substrate to install the thermosensitive recording layer was 155 sec.

Example 5

A thermosensitive recording medium was prepared in the same manner as described in Example 1 with the exception of changing the pulp formulation to 30 parts of TMP, 20 parts of RGB, 5 parts of NBKP and 45 parts of LBKP. The water drop absorbency on the surface of the substrate to install the thermosensitive recording layer was 110 sec.

Example 6

A thermosensitive recording medium was prepared in the same manner as described in Example 1 with the exception of using substrate 2 instead of support 1.

Example 7

A thermosensitive recording medium was prepared in the same manner as described in Example 6 with the exception of changing the pulp formulation to 5 parts of TMP and 95 parts of used paper (the content of mechanical pulp is 10%, hereinafter the same). The water drop absorbency on the surface of the substrate to install the thermosensitive recording layer was 90 sec.

Example 8

A thermosensitive recording medium was prepared in the same manner as described in Example 7 with the exception of changing the dried coating amount of cationic sizing agent of both sides to 0.04 g/m$^2$ (the dried coating amount on the surface to install the thermosensitive recording layer is 0.02 g/m$^2$). The water drop absorbency on the surface of the substrate to install the thermosensitive recording layer was 60 sec.

Example 9

A thermosensitive recording medium was prepared in the same manner as described in Example 7 with the exception of changing the dried coating amount of cationic sizing agent of both sides to 0.08 g/m$^2$ (the dried coating amount on the surface to install the thermosensitive recording layer is 0.04 g/m$^2$). The water drop absorbency on the surface of the substrate to install the thermosensitive recording layer was 150 sec.

Example 10

A thermosensitive recording medium was prepared in the same manner as described in Example 7 with the exception of adding alkylketen dimer (Seiko PMC Corporation, AD1604, solid content: 30%) to the pulp slurry as an internal sizing agent in paper making process so that the solid content of the AKD is 0.15 weight % of the pulp. The water drop absorbency on the surface of the substrate to install the thermosensitive recording layer was 110 sec.

Example 11

A thermosensitive recording medium was prepared in the same manner as described in Example 6 with the exception of changing the pulp formulation to 20 parts of TMP and 80 parts of used paper. The water drop absorbency on the surface of the substrate to install the thermosensitive recording layer was 80 sec.

Example 12

A thermosensitive recording medium was prepared in the same manner as described in Example 6 with the exception of changing the pulp formulation to 40 parts of TMP and 60 parts of used paper. The water drop absorbency on the surface of the substrate to install the thermosensitive recording layer was 70 sec.

Example 13

A thermosensitive recording medium was prepared in the same manner as described in Example 7 with the exception that the basic weight of the support is 30 g/m$^2$. The water drop absorbency on the surface of the substrate to install the thermosensitive recording layer was 90 sec.

Example 14

A thermosensitive recording medium was prepared in the same manner as described in Example 7 with the exception that the basic weight of the support is 80 g/m$^2$. The water drop absorbency on the surface of the substrate to install the thermosensitive recording layer was 90 sec.

Example 15

A thermosensitive recording medium was prepared in the same manner as described in Example 6 with the exception of changing the pulp formulation to 10 parts of LBKP and 90 parts of used paper. The water drop absorbency on the surface of the substrate to install the thermosensitive recording layer was 90 sec.

Example 16

A thermosensitive recording medium was prepared in the same manner as described in Example 6 with the exception of changing the pulp formulation to 60 parts of TMP and 40 parts of LBKR The water drop absorbency on the surface of the substrate to install the thermosensitive recording layer was 50 sec.

Example 17

A thermosensitive recording medium was prepared in the same manner as described in Example 7 with the exception of changing the cationic sizing agent in the clear size coating solution to alkylketen dimer (Seiko PMC Corporation, SK Resin S-20). The water drop absorbency on the surface of the substrate to install the thermosensitive recording layer was 90 sec.

Example 18

A thermosensitive recording medium was prepared in the same manner as described in Example 6 with the exception of not installing the undercoating layer.

Example 19

A thermosensitive recording medium was prepared in the same manner as described in Example 6 with the exception of changing the pulp formulation to 10 parts of TMP, 10 parts of RGP with CSF of 70 ml, 5 parts of NBKP with CSF of 470 ml and 75 parts of LBKP, and the dried coating amount of cationic sizing agent of both sides to 0.4 g/m$^2$ (the dried coating amount on the surface to install the thermosensitive recording layer is 0.2 g/m$^2$). The water drop absorbency on the surface of the substrate to install the thermosensitive recording layer was 230 sec.

Example 20

A thermosensitive recording medium was prepared in the same manner as described in Example 6 with the exception of changing the pulp formulation to 10 parts of TMP, 10 parts of RGP, 5 parts of NBKP and 75 parts of LBKP, and the dried coating amount of cationic sizing agent of both sides to 0.6 g/m$^2$ (the dried coating amount on the surface to install the thermosensitive recording layer is 0.3 g/m$^2$). The water drop absorbency on the surface of the substrate to install the thermosensitive recording layer was 340 sec.

Example 21

A thermosensitive recording medium was prepared in the same manner as described in Example 6 with the exception of changing the pulp formulation to 10 parts of TMP, 10 parts of RGP, 5 parts of NBKP and 75 parts of LBKP, and the dried coating amount of cationic sizing agent of both sides to 1.0 g/m$^2$ (the dried coating amount on the surface to install the thermosensitive recording layer is 0.5 g/m$^2$). The water drop absorbency on the surface of the substrate to install the thermosensitive recording layer was 700 sec.

Example 22

A thermosensitive recording medium was prepared in the same manner as described in Example 6 with the exception of changing the pulp formulation to 10 parts of TMP, 10 parts of RGP, 5 parts of NBKP and 75 parts of LBKP, and changing the cationic sizing agent in the clear size coating solution to anionic sizing agent (Arakawa Chemical Industries Ltd., anionic polymer of styrene-acrylic acid copolymer, PM1343) so that the dried coating amount of anionic sizing agent of both sides is 0.15 g/m$^2$ (the dried coating amount on the surface to install the thermosensitive recording layer is 0.075 g/m$^2$). The water drop absorbency on the surface of the substrate to install the thermosensitive recording layer was 70 sec.

Example 23

A thermosensitive recording medium was prepared in the same manner as described in Example 6 with the exception of changing the pulp formulation to 10 parts of TMP, 10 parts of RGP, 5 parts of NBKP and 75 parts of LBKP, and changing the cationic sizing agent in the clear size coating solution to anionic sizing agent (Arakawa Chemical Industries Ltd., anionic polymer of styrene-acrylic acid copolymer, PM1343) so that the dried coating amount of anionic sizing agent of both sides is 1.0 g/m$^2$ (the dried coating amount on the surface to install the thermosensitive recording layer is 0.5 g/m$^2$). The water drop absorbency on the surface of the substrate to install the thermosensitive recording layer was 450 sec.

Example 24

A thermosensitive recording medium was prepared in the same manner as described in Example 6 with the exception of changing the pulp formulation to 10 parts of TMP, 10 parts of RGP, 5 parts of NBKP and 75 parts of LBKP, and changing the cationic sizing agent in the clear size coating solution to synthesized nonionic sizing agent (Arakawa Chemical Industries Ltd., synthesized nonionic oligomer, WSA40) so that the dried coating amount of synthesized nonionic sizing agent of both sides is 0.8 g/m$^2$ (the dried coating amount on the surface to install the thermosensitive recording layer is 0.4 g/m$^2$). The water drop absorbency on the surface of the substrate to install the thermosensitive recording layer was 50 sec.

Comparative Example 1

A thermosensitive recording medium was prepared in the same manner as described in Example 1 with the exception of changing the pulp formulation to 100 parts of LBKP. The water drop absorbency on the surface of the substrate to install the thermosensitive recording layer was 190 sec.

Comparative Example 2

A thermosensitive recording medium was prepared in the same manner as described in Example 1 with the exception of changing the pulp formulation to 100 parts of LBKP, and adding a bulking agent (Kao Corporation, ester of polyhydric alcohol and saturated fatty acid, KB115) to the pulp slurry in paper making process so that the solid content of the bulking agent is 0.5 weight % of the pulp. The water drop absorbency on the surface of the substrate to install the thermosensitive recording layer was 160 sec.

Comparative Example 3

A thermosensitive recording medium was prepared in the same manner as described in Comparative Example 1 with the exception of changing CSF of LBKP to 570 ml by changing the strength of refiner during making LBKP in order to increase the bulk of pulp. The water drop absorbency on the surface of the substrate to install the thermosensitive recording layer was 140 sec.

Comparative Example 4

A thermosensitive recording medium was prepared in the same manner as described in Example 6 with the exception of changing the dried coating amount of cationic sizing agent of both sides to 0.02 g/m$^2$ (the dried coating amount on the surface to install the thermosensitive recording layer is 0.01 g/m$^2$). The water drop absorbency on the surface of the substrate to install the thermosensitive recording layer was 30 sec.

Comparative Example 5

A thermosensitive recording medium was prepared in the same manner as described in Comparative Example 4 with the exception of changing the pulp formulation to 100 parts of LBKP, and adding a bulking agent (Kao Corporation, ester of polyhydric alcohol and saturated fatty acid, KB115) to the pulp slurry in paper making process an that the solid content of the bulking agent is 0.5 weight % of the pulp. The water drop absorbency on the surface of the substrate to install the thermosensitive recording layer was 10 sec.

Comparative Example 6

A thermosensitive recording medium was prepared in the same manner as described in Comparative Example 4 with the exception of changing the pulp formulation to 100 parts of LBKP, and changing CSF of LBKP to 570 ml by changing the strength of refiner during making LBKP in order to increase the bulk of pulp. The water drop absorbency on the surface of the substrate to install the thermosensitive recording layer was 10 sec.

Comparative Example 7

A thermosensitive recording medium was prepared in the same manner as described in Example 7 with the exception of changing the dried coating amount of cationic sizing agent of both sides to 0.02 g/m$^2$ (the dried coating amount on the surface to install the thermosensitive recording layer is 0.01 g/m$^2$). The water drop absorbency on the surface of the substrate to install the thermosensitive recording layer was 10 sec.

Comparative Example 8

A thermosensitive recording medium was prepared in the same manner as described in Example 6 with the exception of changing the pulp formulation to 10 parts of TMP, 10 parts of RGP with CSF of 70 ml, 5 parts of NBKP with CSF of 470 ml and 75 parts of LBKP, and changing the cationic sizing agent in the clear size coating solution to anionic sizing agent (Arakawa Chemical Industries Ltd., anionic polymer of styrene-acrylic acid copolymer, PM1343) so that the dried coating amount of anionic sizing agent of both sides is 0.06 g/m$^2$ (the dried coating amount on the surface to install the thermosensitive recording layer is 0.03 g/m$^2$). The water drop absorbency on the surface of the substrate to install the thermosensitive recording layer was 20 sec.

The thermosensitive recording media obtained in the manners described above were evaluated as follows.

<Recorded Density/Record Density>

The prepared thermosensitive recording medium were recorded by using a printing tester for thermosensitive recording paper (Okura Engineering Co. LTD., TH-PMD) at recording energy of 0.35 mJ/dot. The density of the recorded image was measured by using Macbeth Densitometer (RD-914, with Amber filter).

<Recording Property after Storage/Record Density after Storage>

The prepared thermosensitive recording medium was stored at 30 degree C. and 90% RH for 24 hours. After storage, the thermosensitive recording medium were recorded by using a printing tester (Okura Engineering Co. LTD., TH-PMD) at recording energy of 0.35 mJ/dot. The density of the recorded image was measured by using Macbeth Densitometer (RD-914, with Amber filter).

<Bar Code Readability/Print Through Resistance>

The surface opposite to the surface with the thermosensitive recording layer of the thermosensitive recording medium was printed with a black ink for rotary offset press by using RI printer and dried. The surface with the thermosensitive recording layer of the thermosensitive recording medium was recorded with a bar code (CODE39) using a label printer 140XiIII manufactured by Zebra Co., Ltd. The recorded bar code was evaluated by using a bar code reader (Quick Check PC 600 manufactured by Nihon Systex Ltd.). The evaluation was conducted using the ANSI grades (used ten of measurements). A rating C or better result meant that no practical problem was experienced when reading bar codes. Similarly, a rating D or poorer result meant that problems were encountered as far as bar code readability was concerned.

<Surface Strength>

The surface opposite to the surface with the thermosensitive recording layer of the thermosensitive recording medium was printed with an ink for sheet-fed offset press (Toyo Ink Co., Ltd. Hi-unity M) by using a sheet-fed offset printing machine manufactured by Roland Corporation. Then picking has evaluated on the solidly printed area by a visual inspection. The picking means that the surface of the substrate is pulled off by the tackiness of the ink on the printing machine.

Excellent: No picking or peeling

Good: Almost no picking or peeling

Fair: Slight picking or peeling, but no practical problem

Poor: Much picking or peeling or the support was destroyed

The results are shown in the table below.

TABLE 1

| | Substrate | | | | External sizing agent | | | Quality | | | |
|---|---|---|---|---|---|---|---|---|---|---|---|
| | | | | | | coating | | Recording | | | |
| | mechanical pulp (%) | used paper | water drop absorbency sec. | basic weight g/m2 | Sizing agent | amount of one side g/m2 | Under-coating layer | Recorded density | property after storage | Bar code readability | Surface strength |
| Example 1 | 20 | — | 170 | 48 | cationic | 0.075 | installed | 1.30 | 1.19 | 2.9 | Excellent |
| Example 2 | 40 | — | 150 | 48 | " | 0.075 | " | 1.25 | 1.10 | 2.6 | Good |
| Example 3 | 70 | — | 100 | 48 | " | 0.075 | " | 1.22 | 1.03 | 2.0 | Good |
| Example 4 | 20 | — | 155 | 48 | " | 0.075 | " | 1.28 | 1.14 | 2.7 | Good |
| Example 5 | 50 | — | 110 | 48 | " | 0.075 | " | 1.25 | 1.02 | 2.1 | Fair |

TABLE 1-continued

| | Substrate | | | | External sizing agent | | | Quality | | | |
|---|---|---|---|---|---|---|---|---|---|---|---|
| | | | | | | coating | | | Recording | | |
| | mechanical pulp (%) | used paper | water drop absorbency sec. | basic weight g/m2 | Sizing agent | amount of one side g/m2 | Under-coating layer | Recorded density | property after storage | Bar code readability | Surface strength |
| Example 6 | 20 | — | 110 | 48 | " | 0.03 | " | 1.27 | 1.05 | 2.3 | Excellent |
| Example 7 | 14.5 | use | 90 | 48 | " | 0.03 | " | 1.24 | 0.93 | 2.2 | Good |
| Example 8 | 14.5 | " | 60 | 48 | " | 0.02 | " | 1.17 | 0.88 | 2.0 | Good |
| Example 9 | 14.5 | " | 150 | 48 | " | 0.04 | " | 1.32 | 1.10 | 2.5 | Good |
| Example 10 | 14.5 | " | 110 | 48 | " | 0.03 | " | 1.28 | 1.03 | 2.3 | Good |
| Example 11 | 28 | " | 80 | 48 | " | 0.03 | " | 1.24 | 0.88 | 2.8 | Good |
| Example 12 | 46 | " | 70 | 48 | " | 0.03 | " | 1.22 | 0.86 | 2.2 | Good |
| Example 13 | 14.5 | " | 90 | 30 | " | 0.03 | " | 1.22 | 0.92 | 2.0 | Good |
| Example 14 | 14.5 | " | 90 | 80 | " | 0.03 | " | 1.23 | 0.91 | 2.6 | Good |
| Example 15 | 9 | " | 90 | 48 | " | 0.03 | " | 1.25 | 0.94 | 2.0 | Good |
| Example 16 | 60 | — | 50 | 48 | " | 0.03 | " | 1.21 | 0.89 | 1.9 | Fair |
| Example 17 | 14.5 | use | 90 | 48 | AKD | 0.03 | " | 1.22 | 1.00 | 2.4 | Good |
| Example 18 | 20 | — | 110 | 48 | cationic | 0.03 | not installed | 1.00 | 0.84 | 1.9 | Excellent |
| Example 19 | 20 | — | 230 | 48 | " | 0.2 | installed | 1.33 | 1.22 | 2.8 | Good |
| Example 20 | 20 | — | 340 | 48 | " | 0.3 | " | 1.34 | 1.22 | 1.8 | Good |
| Example 21 | 20 | — | 700 | 48 | " | 0.5 | " | 1.35 | 1.23 | 1.4 | Good |
| Example 22 | 20 | — | 70 | 48 | anionic | 0.075 | " | 1.22 | 0.97 | 2.0 | Good |
| Example 23 | 20 | — | 450 | 48 | " | 0.5 | " | 1.23 | 1.07 | 1.2 | Good |
| Example 24 | 20 | — | 50 | 48 | ninionic | 0.4 | " | 1.15 | 0.86 | 1.7 | Good |
| Comparative Example 1 | 0 | — | 190 | 48 | cationic | 0.075 | " | 1.30 | 1.19 | 1.2 | Good |
| Comparative Example 2 | 0 | — | 160 | 48 | " | 0.075 | " | 1.28 | 1.10 | 1.0 | Fair |
| Comparative Examole 3 | 0 | — | 140 | 48 | " | 0.075 | " | 1.19 | 0.85 | 0.9 | Fair |
| Comparative Example 4 | 20 | — | 30 | 48 | " | 0.01 | " | 1.05 | 0.82 | 1.4 | Excellent |
| Comparative Example 5 | 0 | — | 10 | 48 | " | 0.01 | " | 0.98 | 0.78 | 0.4 | Fair |
| Comparative Example 6 | 0 | — | 10 | 48 | " | 0.01 | " | 1.03 | 0.83 | 0.6 | Fair |
| Comparative Example 7 | 14.5 | use | 10 | 48 | " | 0.01 | " | 1.00 | 0.71 | 1.5 | Good |
| Comparative Example 8 | 20 | — | 20 | 48 | anionic | 0.03 | " | 1.08 | 0.90 | 0.9 | Good |

* AKD: alkylketen dimer

What is claimed is:

1. A thermosensitive recording medium having a thermosensitive recording layer containing a colorless or pale electron donating leuco dye and an electron accepting color developing agent on a substrate, wherein the substrate comprises pulps containing from 5 to 50 weight % of mechanical pulp, and the substrate is treated by a sizing agent so that water drop absorbency of a surface of the substrate on which the thermosensitive recording layer is installed is from 50 to 200 seconds, wherein the water drop absorbency is measured according to the testing standard J. TAPPI No. 32-2:2000 of Japan Technical Association of the Pulp and Paper Industry with the exception that the volume of the water drop is 0.001 ml.

2. The thermosensitive recording medium of claim 1, wherein the water drop absorbency is represented by the time necessary for the substrate to absorb a dropped water, which is measured by visual inspection, wherein a test paper is positioned horizontally and 1 micro liter (0.001 ml) of distilled water is dropped on a surface of the test paper.

3. The thermosensitive recording medium of claim 1, wherein the water drop absorbency is from 100 to 200 seconds.

4. The thermosensitive recording medium of any of claims 1-3, wherein the substrate comprises pulps containing from 10 to 50 weight % of mechanical pulp.

5. The thermosensitive recording medium of claim 4, wherein the basic weight of the substrate is from 30 to 100 $g/m^2$.

6. The thermosensitive recording medium of claim 4, wherein an undercoating layer comprising a binder and a pigment is installed between the substrate and the thermosensitive recording layer and the coating amount of the undercoating layer is 15 $g/m^2$ or less.

7. The thermosensitive recording medium of claim 1, wherein the mechanical pulp is thermo mechanical pulp (TMP).

8. The thermosensitive recording medium of claim 1, wherein the sizing agent is coated on at least one surface of the substrate after a paper making process.

9. The thermosensitive recording medium of claim 8, wherein the sizing agent is a cationic polymer of styrene-acrylic acid type copolymer or alkyl ketene dimer (AKD).

10. The thermosensitive recording medium of any one of claims 1-3 or 7-9, wherein the basic weight of the substrate is from 30 to 100 $g/m^2$.

11. The thermosensitive recording medium of claim 10, wherein an undercoating layer comprising a binder and a pigment is installed between the substrate and the thermosensitive recording layer and the coating amount of the undercoating layer is 15 $g/m^2$ or less.

12. The thermosensitive recording medium of any one of claims 1-3 or 7-9, wherein an undercoating layer comprising a binder and a pigment is installed between the substrate and the thermosensitive recording layer and the coating amount of the undercoating layer is 15 $g/m^2$ or less.

13. The thermosensitive recording medium of claim 1, wherein recycled pulp is used in the substrate.

* * * * *